US008267603B2

(12) United States Patent
Morita et al.

(10) Patent No.: US 8,267,603 B2
(45) Date of Patent: Sep. 18, 2012

(54) SHEET MATERIAL CUTTER AND PRINTER

(75) Inventors: Seiji Morita, Sayama (JP); Tadashi Kashio, Tokorozawa (JP)

(73) Assignee: Citizen Holdings Co., Ltd., Tokyo (JP)

( * ) Notice: Subject to any disclaimer, the term of this patent is extended or adjusted under 35 U.S.C. 154(b) by 990 days.

(21) Appl. No.: 12/223,485

(22) PCT Filed: Jan. 18, 2007

(86) PCT No.: PCT/JP2007/051110

§ 371 (c)(1),
(2), (4) Date: Jul. 31, 2008

(87) PCT Pub. No.: WO2007/088760

PCT Pub. Date: Aug. 9, 2007

(65) Prior Publication Data

US 2009/0013846 A1 Jan. 15, 2009

(30) Foreign Application Priority Data

Jan. 31, 2006 (JP) ..... 2006-022594

(51) Int. Cl.
*B41J 11/70* (2006.01)
*B26D 1/08* (2006.01)

(52) U.S. Cl. ..... 400/621; 83/695

(58) Field of Classification Search ..... 400/621; 83/695; *B41J 11/70; B26D 1/08, 1/09*
See application file for complete search history.

(56) References Cited

U.S. PATENT DOCUMENTS 3,772,955 A * 11/1973 Pearl ..... 83/746
5,001,956 A * 3/1991 Nitsch ..... 83/620
5,235,887 A * 8/1993 Moriya ..... 83/282
7,273,325 B2 9/2007 Watanabe et al.
2005/0036820 A1 * 2/2005 Watanabe et al. ..... 400/621

FOREIGN PATENT DOCUMENTS

| | | | |
|---|---|---|---|
| JP | 58-86362 | | 6/1983 |
| JP | 6-047696 | | 2/1994 |
| JP | 7-75994 | | 3/1995 |
| JP | 08142429 | A * | 6/1996 |
| JP | 08309689 | A * | 11/1996 |
| JP | 11048187 | A * | 2/1999 |
| JP | 2001-341370 | | 12/2001 |
| JP | 2001341370 | A * | 12/2001 |
| JP | 2002137191 | A * | 5/2002 |
| JP | 2003-320721 | | 11/2003 |
| JP | 2004035054 | A * | 2/2004 |
| JP | 2005-001030 | | 1/2005 |
| JP | 2005-059395 | | 3/2005 |
| JP | 2005-074571 | | 3/2005 |
| JP | 2005-74598 | | 3/2005 |
| JP | 2005-103745 | | 4/2005 |
| JP | 2005103745 | A * | 4/2005 |
| JP | 2005-324301 | | 11/2005 |

* cited by examiner

*Primary Examiner* — Daniel J Colilla

(74) *Attorney, Agent, or Firm* — Jordan and Hamburg LLP

(57) ABSTRACT

A fixed blade and a movable blade in which a cutting portion end face of the movable blade is orthogonal to a side surface of the movable blade, and the movable blade is brought into sliding contact with the fixed blade to cut a recording sheet. A cutout groove for forming a cutting residual portion in the recording sheet is formed in the cutting portion of the movable blade. A slant surface or a curved surface is formed at an intersection of the side surface of the movable blade, a cutting portion end face of the movable blade and the inner peripheral surface of the cutout groove.

12 Claims, 12 Drawing Sheets

SHEET MATERIAL CUTTER AND PRINTER

TECHNICAL FIELD

The present invention relates to a sheet material cutter for cutting a sheet material by sliding contact between a fixed blade and a movable blade, and more particularly to a sheet material cutter that can partially cut the sheet material while leaving a cutting residual portion of the sheet material.

BACKGROUND ART

As this type of sheet cutter are known those which are disclosed in JP-A-6-47696 and JP-A-2005-74598.

In the sheet cutter disclosed in JP-A-6-47696, a movable blade is formed of a thin plate type cutting steel having a cutting blade whose blade edge line is recessed in a V-shape, and a cutout groove is processed at the center portion of the cutting blade. By controlling the reciprocating movement amount of the movable blade, the sheet cutter can perform partial cutting (partial cut) by which a part of a sheet is left at the cutout groove and full cutting (full width cut).

Furthermore, in the case of the cutter disclosed in JP-A-2005-74598, the cutting portion of the movable blade is formed substantially in a V-shape having a pair of slants, and cutouts are formed in the slants forming the cutting portion. The cutouts serve to form cutting residual portions of a sheet. An acicular pointed portion is formed at a portion nearer to the center of the movable blade out of the entrances of the cutouts. The pointed portion sticks into a sheet to smoothly start the cutting operation. This pointed portion is formed by processing the slant surface of the cutting portion over the area from the cutout portion of the slant to the cutout portion at the center (see FIG. 12 of JP-A-2005-74598).

As disclosed in JP-A-6-47696, in the sheet cutter having the cutout groove in the movable blade, a sheet is cut in cooperation of the fixed blade and the movable blade, however, the shearing action on the sheet is lost at the instantaneous time when the fixed blade crosses the cutout groove of the movable blade. At this time, the sheet is pressed against the fixed blade, and torn off and broken at the opening end portion of the cutout groove.

Therefore, there occurs a problem that front and rear sheets are separated from each other in spite of partial cutting or breakage of the sheet progresses to the inside of the sheet when a cutting residual portion is afterwards cut off and thus the sheet cannot be beautifully cut off.

Furthermore, even in the case of the cutter disclosed in JP-A-2005-74598, the acicular pointed portion is formed at a portion nearer to the center of the movable blade out of the entrances of the cutouts, however, an edge having a thickness remains at the entrance of the cutout portion at the side confronting the portion concerned, and thus there is a risk that the same problem as the cutout groove of JP-A-6-47696 may occur.

In addition, the pointed portion disclosed in JP-A-2005-74598 is formed by processing the cutting portion on the slant surface over the area from the cutout portion of the slant to the cutout of the center, and thus a cumbersome polishing work is required for the processing of the slant surface. The sheet cutter has a problem that the edge of the cutting portion is liable to be nicked because the cutting portion is formed on the slant surface and thus the durability of the sheet cutter is lowered.

The present invention has been implemented in view of the situation as described above, and has an object to make manufacturing easy, enhance the durability of a cutting portion and enable excellent formation of a cutting residual portion of a sheet material when the sheet material is partially cut.

DISCLOSURE OF THE INVENTION

In order to attain the above object, the present invention is characterized by comprising a fixed blade and a movable blade are provided, wherein the movable blade is brought into sliding contact with the fixed blade to cut a sheet material, a cutout groove for forming a cutting residual portion in the sheet material is formed at a fixed depth from the end face of a cutting portion of the movable blade in a cutting operation direction, and a slant surface or a curved surface is formed at a corner portion corresponding to a cross point of respective surfaces of a surface of the movable blade which does not face the fixed blade, the end face of the cutting portion which is orthogonal to the surface concerned and the inner peripheral surface of the cutout groove.

According to the present invention, with respect to the movable blade, the end face of the cutting portion is orthogonal to the surface of the movable blade, so that the edge of the cutting portion is hardly nicked and high durability can be kept. Furthermore, the slant surface or the curved surface is formed at the corner portion corresponding to the cross point of the respective surfaces of the surface of the movable blade which does not face the fixed blade, the end face of the cutting portion of the movable blade and the inner peripheral surface of the cutout groove, whereby the thickness of the opening end of the cutout groove is reduced. As a result, there is no risk that the sheet material is torn off and broken at the opening end portion of the cutout groove, and an excellent cutting residual portion can be formed.

Furthermore, in the present invention, the slant surface or the curved surface is formed at only the corner portion and thus it can be easily processed by press working.

BEST MODES FOR CARRYING OUT THE INVENTION

Embodiments according to the present invention will be described in detail with reference to the drawings.

First, a printer in which a sheet material cutter of an embodiment is installed will be briefly described with reference to FIG. 1.

Figure 1:
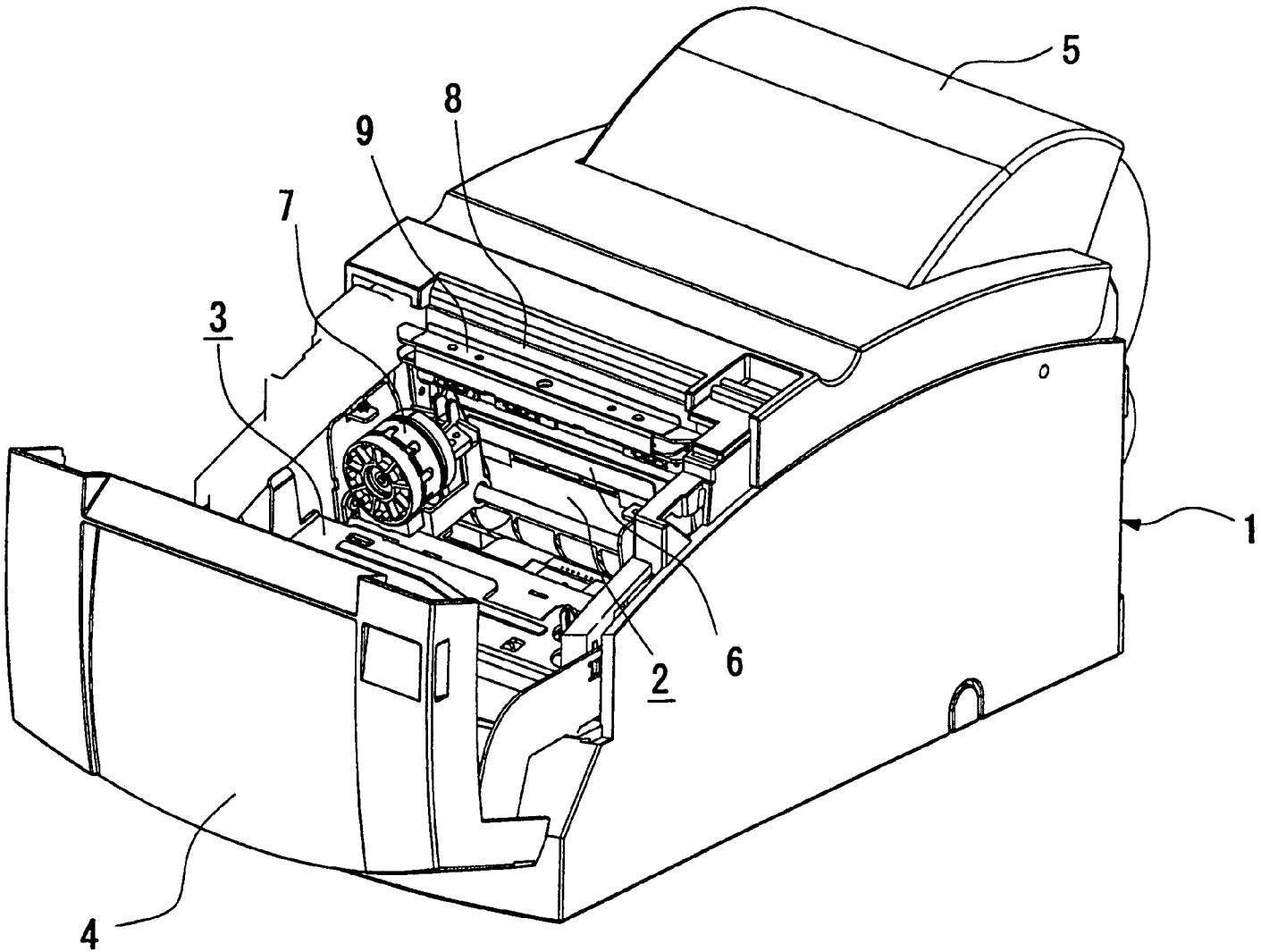
FIG. 1 is a perspective view showing the general outline of a printer according to an embodiment of the present invention.

The printer shown in FIG. 1 has printer main portions such as a print portion 2, amount portion 3 for an ink ribbon cartridge, a recording sheet mount portion (not shown), etc. When a front lid member 4 which is provided to a case main body 1 so as to be freely rotable is opened, the print portion 2 and the cartridge mount portion 3 in the printer can be viewed. Under this state, an ink ribbon cartridge can be loaded/unloaded in the cartridge mount portion 3. A platen 6 and a print head 7 are provided to the print portion 2 so as to face each other. The recording sheet mount portion is provided below a rear lid member 5, and a recording sheet roll comprising a sheet material can be mounted in the recording sheet mount portion under the state that the rear lid member 5 is opened.

The tip of the recording sheet is drawn out from the rear side of the case main body 1 to the gap between the platen 6 and the print head 7, and discharged upwardly in connection with rotation of a sheet feeding roller (recording sheet feeding mechanism) (not shown) disposed between the platen 6 and a roll sheet mount portion. In the print portion 2, the print head 7 is reciprocated in the width direction, and an ink ribbon held in the ink ribbon cartridge is cyclically moved between the recording sheet and the print head 7 to perform printing on the surface of the recording sheet. Here, the platen 6 and the print head 7 constitute a print mechanism for printing data on the recording sheet.

A sheet discharge port 8 is formed at the upper side of the print portion 2 in the case main body 1, and a printed recording sheet is discharged from the sheet discharge port 8 to the outside of the case main body 1. In the printer according to this embodiment, the sheet discharge port 8 is formed at the boundary portion between the front lid member 4 and the rear lid member 5.

A recording sheet cutting mechanism 9 for cutting a printed recording sheet is installed in a recording sheet discharging passage extending from the print portion 2 to the sheet discharge port 8. The recording sheet cutting mechanism 9 is constructed by the sheet material cutter according to this embodiment.

Figure 2:
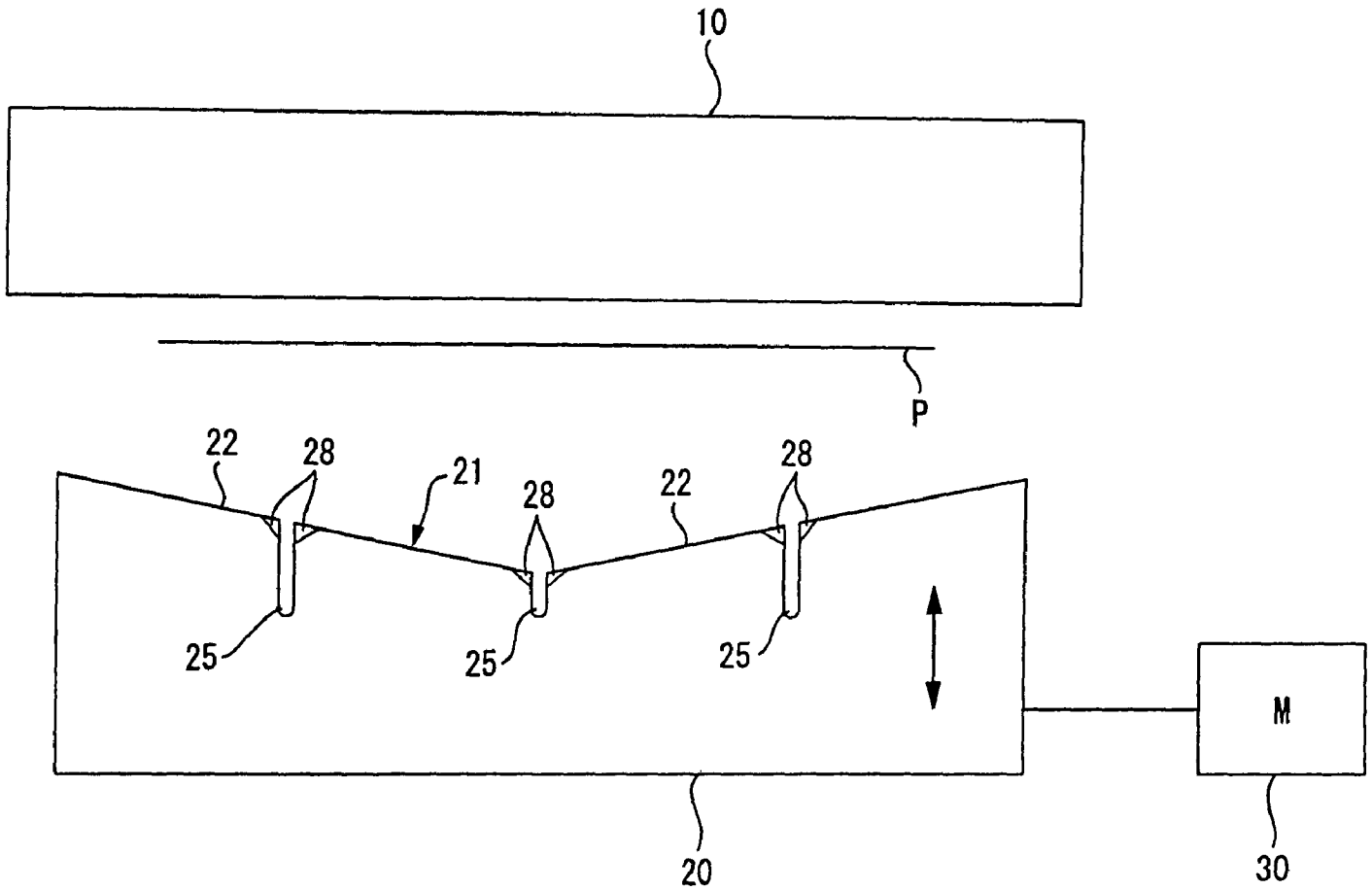
FIG. 2 is a front view showing the simplified construction of a sheet material cutter according to the embodiment.

FIG. 2 is a front view showing the schematic construction of the sheet material cutter constituting the recording sheet cutting mechanism.

The sheet material cutter has a fixed blade 10 and a movable blade 20, and the movable blade 20 is reciprocated in sliding contact with the fixed blade 10 by driving force from a driving motor 30. the recording sheet (sheet material) P is fed to the gap between the fixed blade 10 and the movable blade 20, and suffers shearing action generated by the fixed blade 10 and the movable blade 20, so that the recording sheet P is cut out.

The cutting portion end face 21 of the movable blade 20 is formed substantially in V-shape by a pair of slant surfaces 22 with the center thereof at the bottom portion. In the cutting portion end face 21, cutout grooves 25 are formed at proper places of the respective slant surfaces 22 and the center bottom portion at which the respective slant surfaces 22 cross each other. The cutout groove 25 is used to form a cutting residual portion in the recording sheet P, and it is formed at a fixed depth from the cutting portion end face 21 of the movable blade 20 in the cutting operation direction.

The sheet material cutter according to this embodiment controls the driving motor 30 to change the reciprocating operation amount of the movable blade 20, whereby both the partial cutting operation of forming a cutting residual portion in a recording sheet and the full cutting operation of cutting a recording sheet over the full width so that no cutting residual portion is formed in the recording sheet can be performed. The control of the driving motor 30 is carried out by a controller (not shown) contained in the printer. The controller also controls the print mechanism of the printer and the recording sheet feeding mechanism.

Figure 3A:
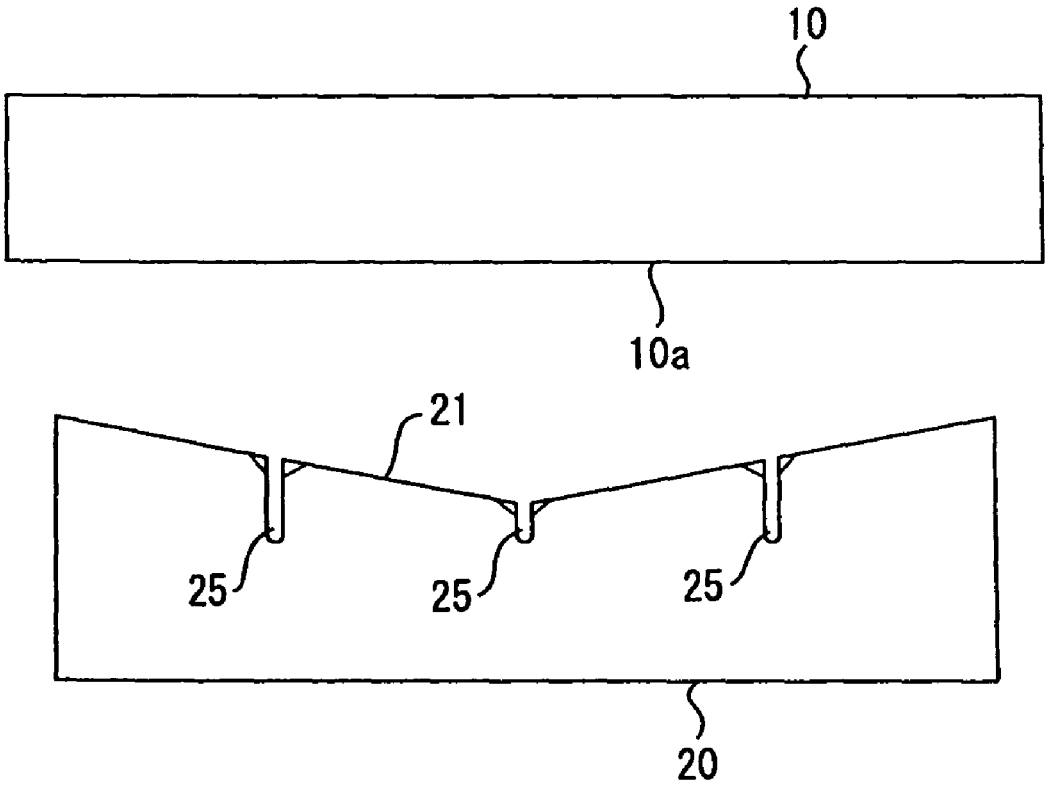
FIGS. 3A, 3B and 3C are diagrams showing a partial cutting operation and a full cutting operation of the sheet material cutter.
Figure 3B:
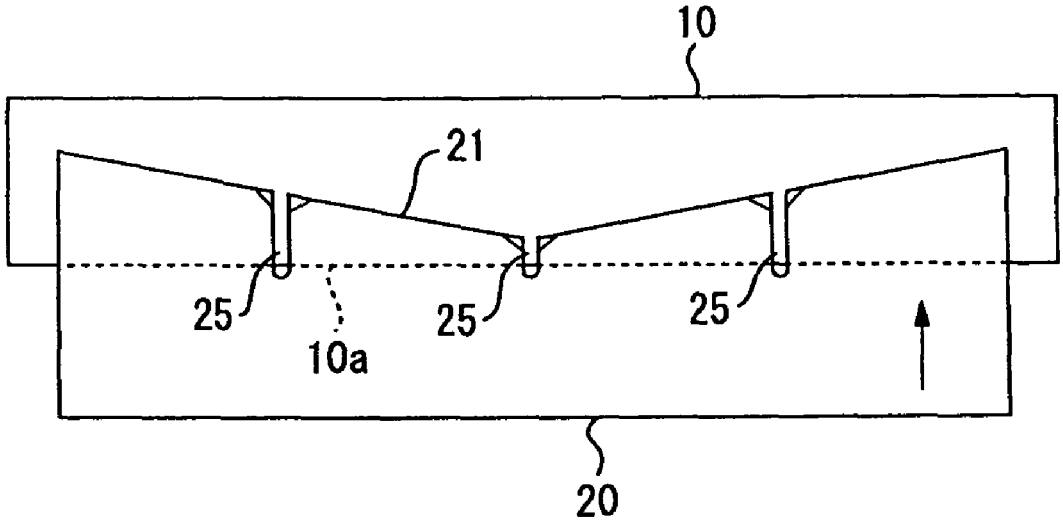
Figure 3C:
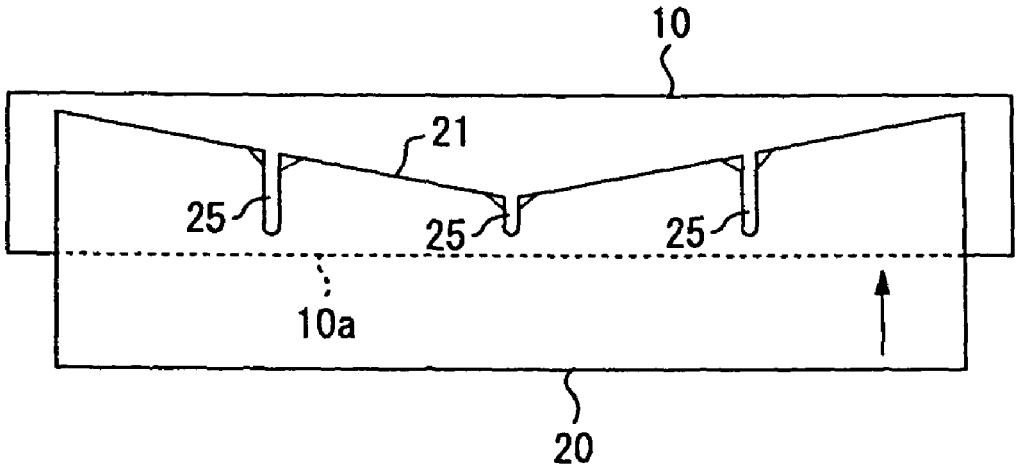

As shown in FIGS. 3A, 3B and 3C, the sheet cutter moves the movable blade 20 from a position at which the fixed blade 10 and the movable blade 20 are under an open state (FIG. 3A), and stops this approach movement of the movable blade 20 when the cutting portion 10*a* of the fixed blade 10 reaches a position which is near to the bottom portions of the cutout grooves 25 formed in the movable blade 20 (FIG. 3B), whereby the partial cutting is implemented.

On the other hand, the sheet cutter moves the movable blade 20 from the open-state position (FIG. 3A), and stops this approach movement of the movable blade 20 when the cutting portion 10*a* of the fixed blade 10 reaches a position beyond the bottom portions of the cutout grooves 25 formed in the movable blade 20 (FIG. 3C), whereby the full cutting is implemented.

Figure 4:
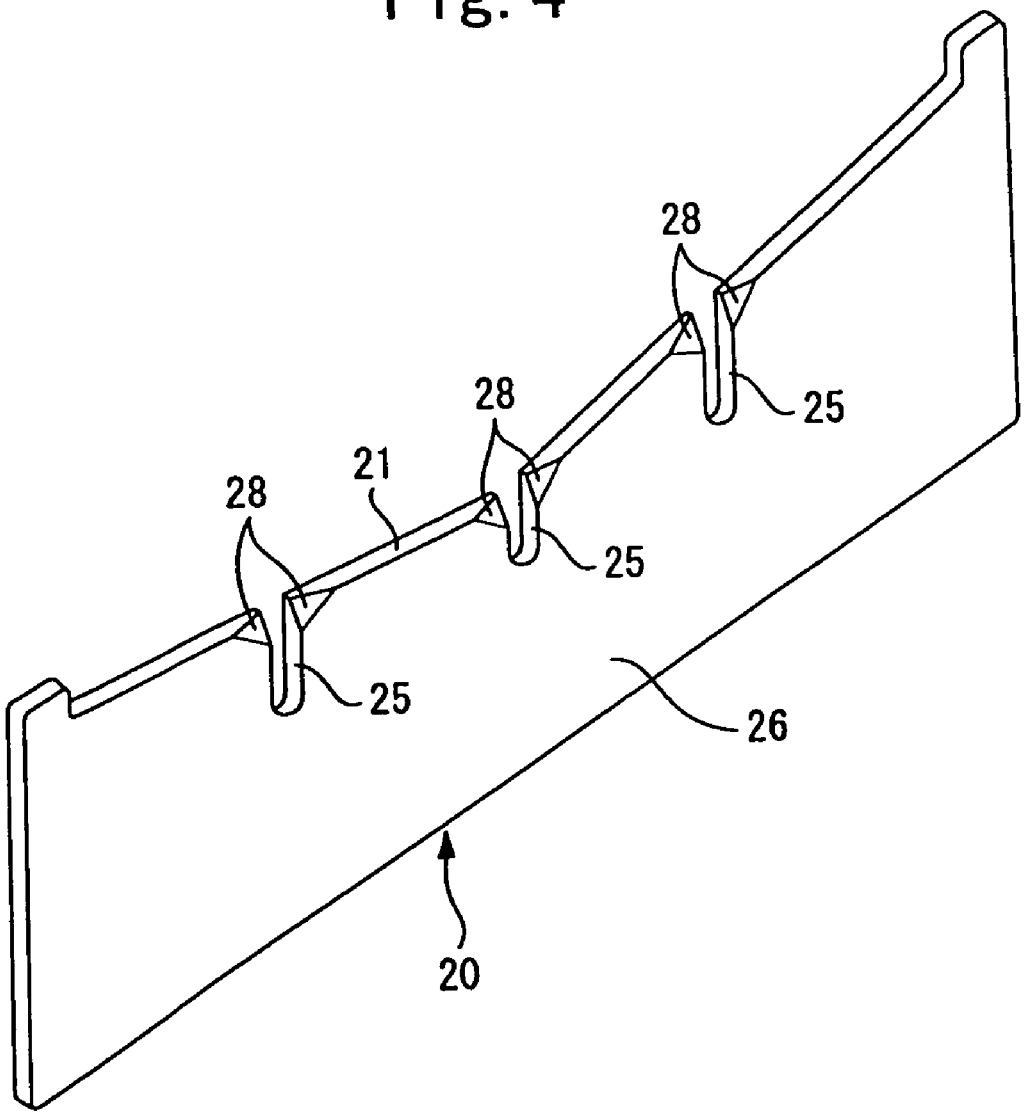
FIG. 4 is a perspective view showing a movable blade 20.

FIG. 4 is a perspective view showing the movable blade. The cutting portion end face 21 of the movable blade 20 is formed so as to be orthogonal to the surface of the movable blade 20. The movable blade 20 is moved in a direction orthogonal to the cutting portion end face 21 and comes into sliding contact with the fixed blade 10, thereby executing the cutting operation of the recording sheet. As a result of the orthogonal formation of the cutting portion end face 21 to the surface, a sufficient thickness can be secured in the cutting portion of the movable blade 20. Accordingly, even when excessively large external force is applied to the cutting portion, the blade is hardly nicked and thus the durability is enhanced.

Figure 5:
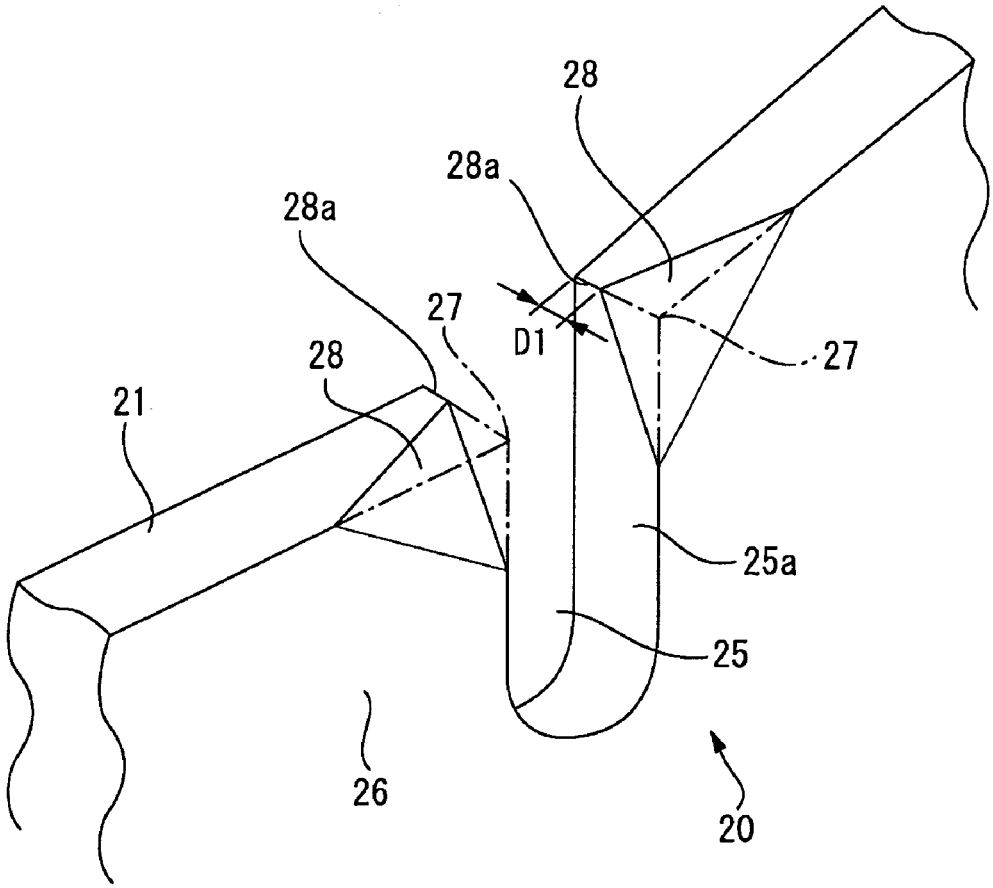
FIG. 5 is an enlarged view showing a part of a cutout groove 25 formed in a movable blade 20.

FIG. 5 is an enlarged view of the portion of the cutout groove formed in the movable blade. In the movable blade 20 of this embodiment, a slant surface 28 is formed at each cross point of respective surfaces of a surface 26 of the movable blade 20 which does not face the fixed blade 10, the cutting end face 21 of the movable blade 20 and the inner peripheral surface 25*a* of the cutout groove 25. This slant surface 28 can be easily formed by press working. By forming the slant surface 28 as described above, the thickness D1 of the cutting blade at the opening end of the cutout groove 25 is small.

Figure 6:
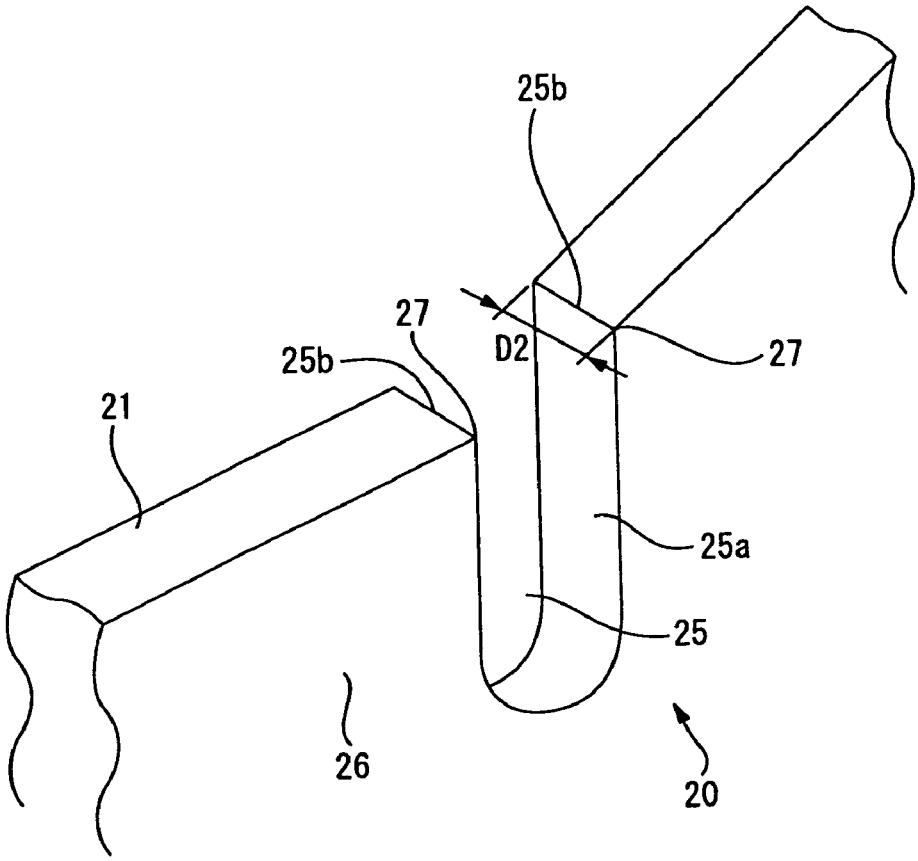
FIG. 6 is a diagram showing a comparison example in which a slant surface 28 is not formed at the corner portion 27 of the opening end of the cutout groove 25.
Figure 8:
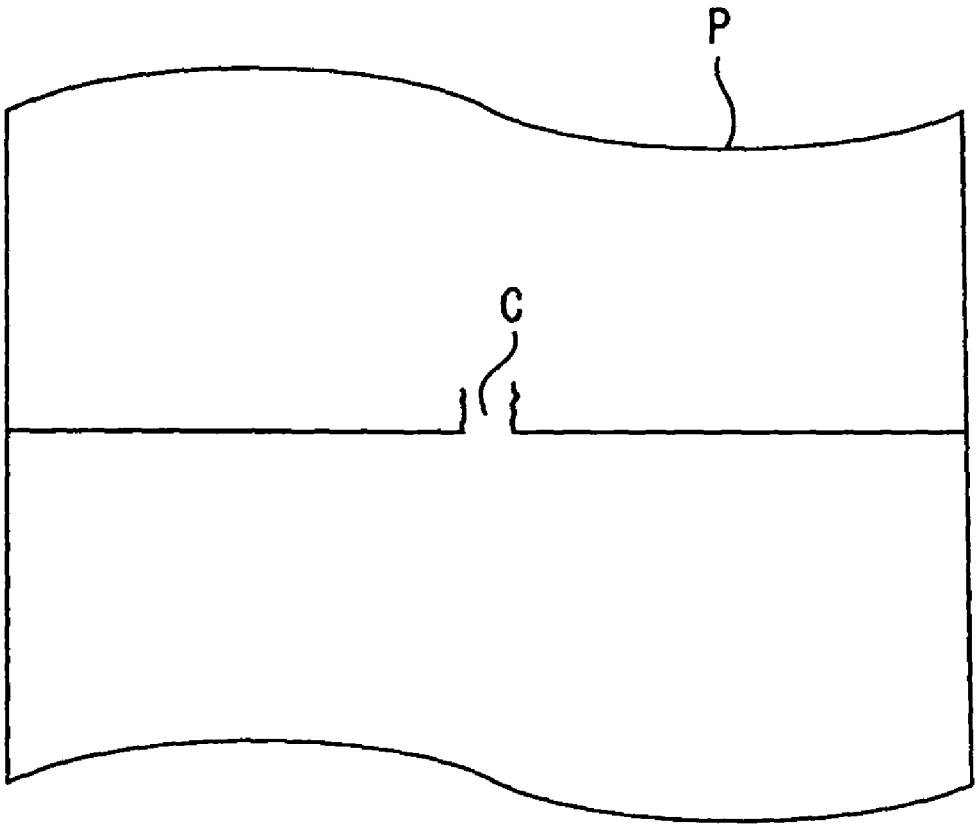
FIG. 8 is a plan view showing a cutting residual portion of a recording sheet cut by a movable blade 20 shown in FIG. 6.

On the other hand, if the corner portion 27 is left as shown in FIG. 6, the thickness D2 of the cutting portion at the opening end of the cutout groove 25 is large. In this case, the recording sheet which is pressed in the depth direction of the cutout groove 25 by the fixed blade 10 would be torn off and broken by the opening end edge 25*b* extending in the thickness of the cutout groove 25. As a result, there occurs a problem that both the side portions of a cutting residual portion C are irregularly broken as shown in FIG. 8 or no cutting residual portion C remains because both the side portions of the cutting residual portion C are torn off.

Figure 7:
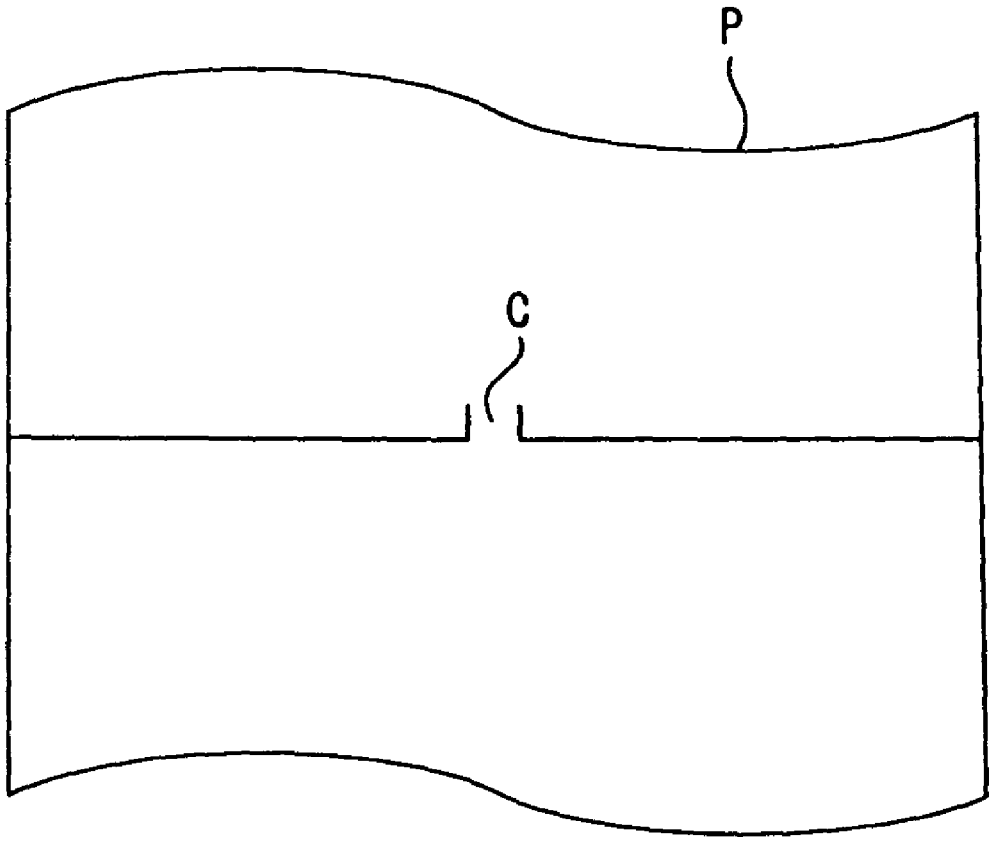
FIG. 7 is a plan view showing a cutting residual portion of a recording sheet cut by the movable blade 20 shown in FIG. 5.

According to this embodiment, the slant surface 28 is formed as described above, and thus the thickness D1 at the opening end of the cutout groove 25 is reduced. Therefore, the recording sheet which is pressed in the depth direction of the cutout groove 25 by the fixed blade 10 is smoothly cut out by the edge 28*a* of the slant surface 28. Therefore, as shown in FIG. 7, the movable blade 20 can form an excellent cutting residual portion C which is linearly cut at both the side portions thereof.

The present invention is not limited to the above embodiment.

Figure 9A:
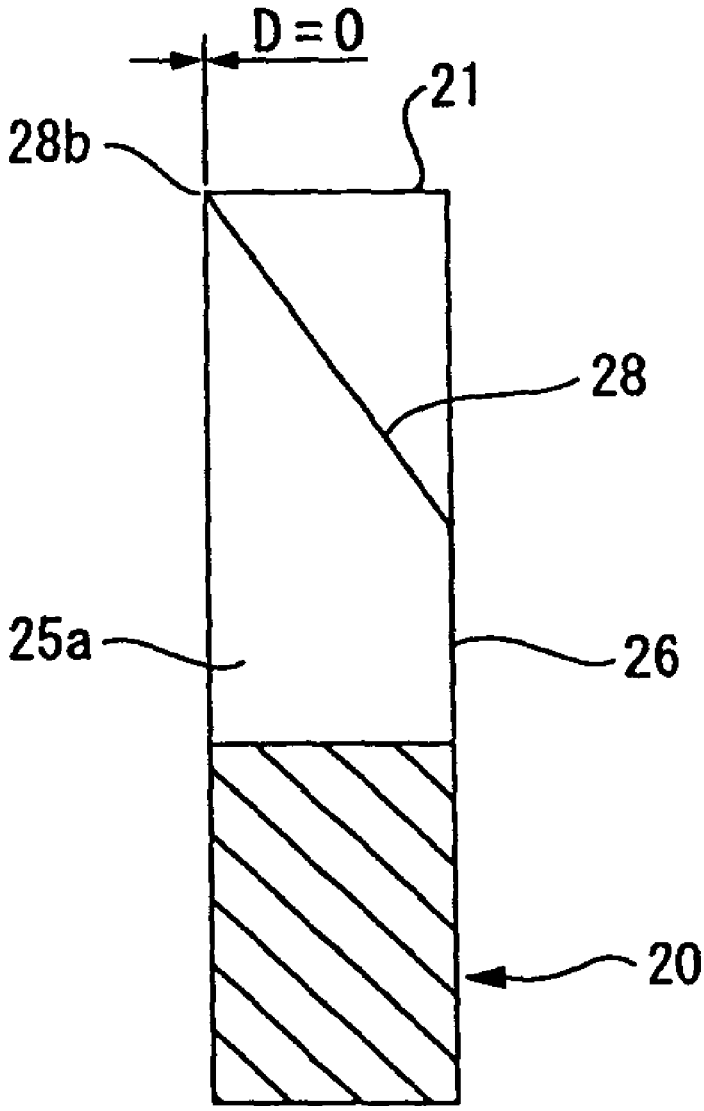
FIGS. 9A and 9B are enlarged cross-sectional views showing a modification of the present invention.

For example, in the sheet cutter, the slant surface 28 may be formed so that the thickness D at the opening end of the cutout groove 25 is nullified (that is, D=0) as shown in FIG. 9A. In such a case, the pointed portion 28*b* is liable to be chipped, and thus the durability is necessarily reduced.

Figure 9B:
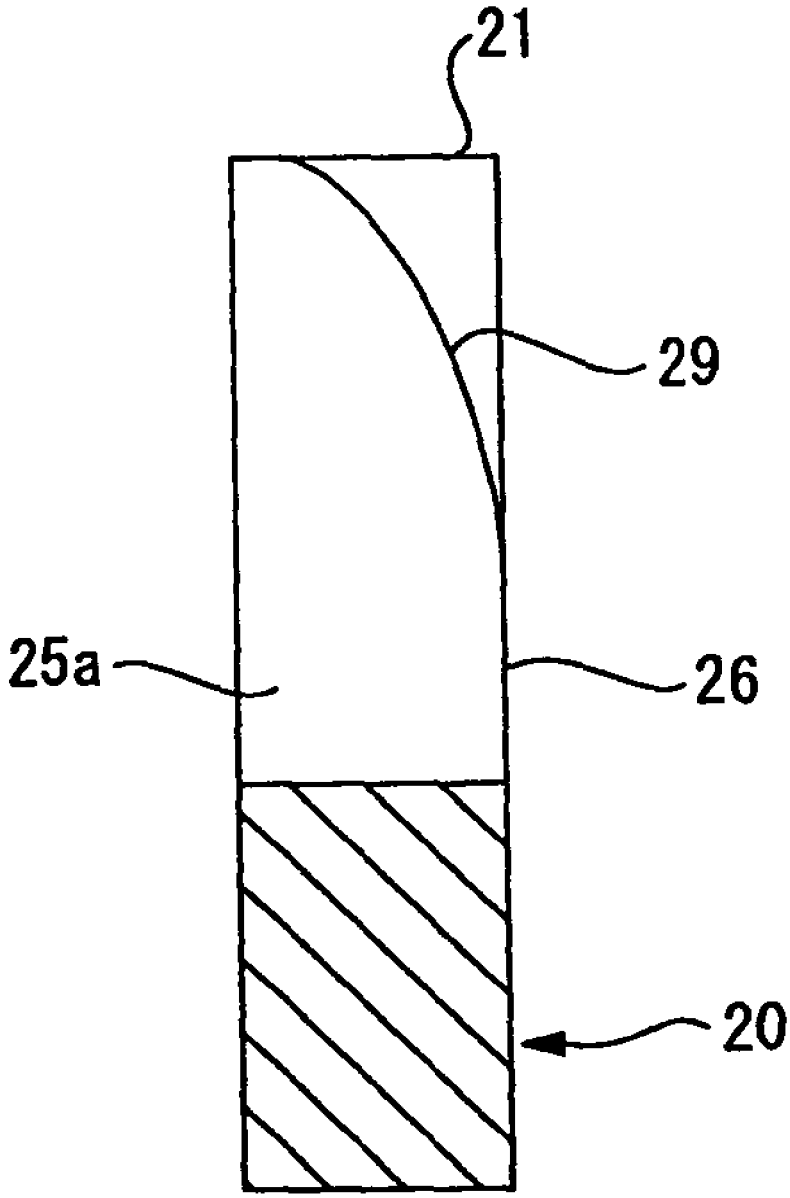

Furthermore, even when a curved surface 29 is formed at the corner portion 27 in place of the slant surface 28 in the sheet cutter as shown in FIG. 9B, an excellent cutting residual portion can be formed as in the case of the slant surface 28.

INDUSTRIAL APPLICABILITY

As described above, according to the present invention, the durability of the cutting portion is high, and also an excellent cutting residual portion can be formed when a sheet material is partially cut.

The invention claimed is:

1. A sheet material cutter comprising;

a fixed blade and a movable blade, the sheet material cutter being configured to bring the movable blade into sliding contact with the fixed blade to cut a sheet material disposed between the fixed blade and the movable blade, the movable blade comprising one or more cutout grooves for forming one or more cutting residual portions in the sheet material when the movable blade is brought into sliding contact, with the fixed blade, the movable blade further comprising respective slant surfaces or curved surfaces having a generally triangular periphery and being located at respective intersections of a side surface of the movable blade which does not face the fixed blade, respective end faces of a cutting portion which are orthogonal to the side surface and respective inner peripheral surfaces of the cutout grooves, and wherein each corresponding one slant or curved surface has a first edge at an adjacent end face of the moving blade, a second edge at an adjacent cutout groove inner peripheral surface, and a third edge at an adjacent side face, said first edge extending for a length less than a length of said adjacent end face, said second edge extending for a length less than a length of said adjacent cutout groove inner peripheral surface, said third edge extending for a length less than a length of said adjacent side face.

2. The sheet material cutter according to claim 1, wherein the cutting portion end faces of the movable blade are formed substantially in a V-shape by a pair of angled surfaces while a center of the V-shape is set as a bottom portion of said V-shape, and at least one of said one or more cutout grooves is formed at the center of the V-shape.

3. The sheet material cutter according to claim 1, wherein said sheet material cutter is configured to selectively reciprocate said movable blade a variable distance so as to provide a partial cutting in which the one or more cutting residual portions are formed in the sheet material or a full cutting in which no cutting residual portions are formed in the sheet material,

4. The sheet material cutter according to claim 1, wherein the slant surfaces or the curved surfaces are formed by press working respective corner portions at intersections of the side surface of the movable blade which does not face the fixed blade, the respective end faces of the cutting portion which are orthogonal to the side surface and the respective inner peripheral surfaces of the cutout grooves.

5. The sheet material cutter according to claim 1, wherein said one or more cutout grooves extend into said movable blade to a predetermined common depth relative to a line orthogonal to a movement of said movable blade, said line intersecting an end face of the cutting portion.

6. A printer comprising:

a print mechanism for printing data on a recording sheet formed of a sheet material to provide a printed recording sheet;

a recording sheet feeding mechanism for feeding the recording sheet;

a recording sheet cutting mechanism for cutting the printed recording sheet; and a controller for controlling the print mechanism, the recording sheet feeding mechanism and the recording sheet cutting mechanism, wherein the recording cutting mechanism comprises a fixed blade and a movable blade and the recording cutting mechanism is configured to bring the movable blade into sliding contact with the fixed blade to cut the sheet material, the movable blade comprising one or more cutout grooves for forming one or more cutting residual portions in the sheet material when the movable blade is brought into sliding contact with the fixed blade, the movable blade further comprising respective slant surfaces or curved surfaces having a generally triangular periphery and being located at respective intersections of a side surface of the movable blade which does not face the fixed blade, respective end faces of the cutting portion which are orthogonal to the side surface and respective inner peripheral surfaces of the cutout grooves; and wherein each corresponding one slant or curved surface has a first edge at an adjacent end face of the moving blade, a second edge at an adjacent cutout groove inner peripheral surface, and a third edge at an adjacent side face, said first edge extending for a length less than a length of said adjacent end face, said second edge extending for a length less than a length of said adjacent cutout groove inner peripheral surface, said third edge extending for a length less than a length of said adjacent side face.

7. The printer according to claim 6, wherein said recording sheet cutting mechanism is configured to selectively reciprocate said movable blade a variable distance on a basis of an instruction from the controller to provide a partial cutting in which the one or more cutting residual portions are formed in the sheet material or a full cutting in which no cutting residual portions are formed in the sheet material.

8. The printer according to claim 6, wherein said one or more cutout grooves extend into said movable blade to a predetermined common depth relative to a line orthogonal to a movement of said movable blade, said line intersecting an end face of the cutting portion.

9. A sheet material cutter comprising:

a fixed blade and a movable blade, the sheet material cutter being configured to bring the movable blade into sliding contact with the fixed blade to cut a sheet material disposed between the fixed blade and the movable blade, the movable blade comprising one or more cutout grooves for forming one or more cutting residual portions in the sheet material when the movable blade is brought into sliding contact with the fixed blade, the movable blade further comprising respective slant surfaces or curved surfaces having a generally triangular periphery and being located at respective intersections of a side surface of the movable blade which does not face the fixed blade, respective end faces of a cutting portion which are orthogonal to the side surface and respective inner peripheral surfaces of the cutout grooves, and wherein for a given cutout groove, there are respective slant surfaces adjacent to each of two respective sidewalls of said given cutout groove, and wherein each one of said adjacent slant surfaces has a planar triangular shape distinct from an adjacent end face and orthogonal to none of the adjacent end face, an adjacent side face, and an adjacent cutout groove inner peripheral surface that form respective straight edges of a corresponding one slant surface of said respective adjacent slant surfaces.

10. A sheet material cutter comprising:

a fixed blade and a movable blade, the sheet material cutter being configured to bring the movable blade into sliding contact with the fixed blade to cut a sheet material disposed between the fixed blade and the movable blade, the movable blade comprising one or more cutout grooves for forming one or more cutting residual portions in the sheet material when the movable blade is brought into sliding contact with the fixed blade, the movable blade further comprising respective slant surfaces or curved surfaces having a generally triangular periphery and being located at respective intersections of a side surface of the movable blade which does not face the fixed blade, respective end faces of a cutting portion which are orthogonal to the side surface and respective inner peripheral surfaces of the cutout grooves, and wherein each corresponding one slant or curved surface is convexly curved.

11. A printer comprising:

a print mechanism for printing data on a recording sheet formed of a sheet material to provide a printed recording sheet;

a recording sheet feeding mechanism for feeding the recording sheet;

a recording sheet cutting mechanism for cutting the printed recording sheet; and a controller for controlling the print mechanism, the recording sheet feeding mechanism and the recording sheet cutting mechanism, the recording cutting mechanism comprises a fixed blade and a movable blade and the recording cutting mechanism is configured to bring the movable blade into sliding contact with the fixed blade to cut the sheet material, the movable blade comprising one or more cutout grooves for forming one or more cutting residual portions in the sheet material when the movable blade is brought into sliding contact with the fixed blade, the movable blade further comprising respective slant surfaces or curved surfaces having a generally triangular periphery and being located at respective intersections of a side surface of the movable blade which does not face the fixed blade, respective end faces of the cutting portion which are orthogonal to the side surface and respective inner peripheral surfaces of the cutout grooves; and wherein for a given cutout groove, there are respective slant surfaces adjacent to each of two respective sidewalls of said given cutout groove, and wherein each one of said adjacent slant surfaces has a planar triangular shape distinct from an adjacent end face and orthogonal to none of the adjacent end face, an adjacent side face, and an adjacent cutout groove inner peripheral surface that form respective straight edges of a corresponding one slant surface of said respective adjacent slant surfaces.

12. A printer comprising:

a print mechanism for printing data on a recording sheet formed of a sheet material to provide a printed recording sheet;

a recording sheet feeding mechanism for feeding the recording sheet;

a recording sheet cutting mechanism for cutting the printed recording sheet; and a controller for controlling the print mechanism, the recording sheet feeding mechanism and the recording sheet cutting mechanism, wherein the recording cutting mechanism comprises a fixed blade and a movable blade and the recording cutting mechanism is configured to bring the movable blade into sliding contact with the fixed blade to cut the sheet material, the movable blade comprising one or more cutout grooves for forming one or more cutting residual portions in the sheet material when the movable blade is brought into sliding contact with the fixed blade, the movable blade further comprising respective slant surfaces or curved surfaces having a generally triangular periphery and being located at respective intersections of a side surface of the movable blade which does not face the fixed blade, respective end faces of the cutting portion which are orthogonal to the side surface and respective inner peripheral surfaces of the cutout grooves; and wherein each corresponding one slant or curved surface is convexly curved.

* * * * *